US006981593B1

(12) United States Patent
Klodt

(10) Patent No.: US 6,981,593 B1
(45) Date of Patent: Jan. 3, 2006

(54) APPARATUS AND METHOD FOR STORING SNACK ITEMS AND SCHOOL SUPPLIES

(76) Inventor: Nancy L. Klodt, 12708 - 160th Ave., Ottumwa, IA (US) 52501

( * ) Notice: Subject to any disclaimer, the term of this patent is extended or adjusted under 35 U.S.C. 154(b) by 0 days.

(21) Appl. No.: 10/766,261

(22) Filed: Jan. 27, 2004

(51) Int. Cl.
*A45C 11/20* (2006.01)

(52) U.S. Cl. ..... 206/541; 206/224; 206/549; 426/120; 53/474

(58) Field of Classification Search ..... 206/541, 206/542, 214, 224, 371, 231, 472, 473, 579, 206/549; 281/18, 30–32; 53/467, 468, 474; 426/115, 119, 120; 434/127, 425
See application file for complete search history.

(56) References Cited

U.S. PATENT DOCUMENTS

| | | | | |
|---|---|---|---|---|
| 3,777,418 A | | 12/1973 | Cooper | |
| 4,106,597 A | | 8/1978 | Shook et al. | |
| 4,308,951 A | * | 1/1982 | Walker, Jr. | 206/214 |
| 5,002,401 A | | 3/1991 | Blackman | |
| 5,074,417 A | | 12/1991 | Kenny | |
| 5,234,143 A | | 8/1993 | Mahvi et al. | |
| 5,338,202 A | * | 8/1994 | Saari | 434/127 |
| D366,210 S | | 1/1996 | McConner | |
| 5,595,302 A | | 1/1997 | Maydwell et al. | |
| 5,950,834 A | * | 9/1999 | Woodnorth et al. | 206/541 |
| 6,237,776 B1 | | 5/2001 | Mogil | |
| 6,279,747 B1 | | 8/2001 | Zegarra | |
| 6,349,820 B1 | * | 2/2002 | Kelley et al. | 206/472 |
| 6,371,288 B1 | | 4/2002 | Licata | |
| 6,382,421 B1 | | 5/2002 | Dao | |
| 6,481,577 B1 | * | 11/2002 | Roegner | 206/581 |
| 6,527,123 B1 | * | 3/2003 | Ausaf | 206/541 |

FOREIGN PATENT DOCUMENTS

DE 32 40 408 A1 5/1984

* cited by examiner

*Primary Examiner*—Luan K. Bui
(74) *Attorney, Agent, or Firm*—McKee, Voorhees & Sease, P.L.C.

(57) ABSTRACT

An apparatus for storing and transporting supplies and snacks includes a top portion having first and second opposite sides, a bottom portion having first and second opposite sides, a middle portion having first and second opposite sides, wherein in a closed position the top portion, bottom portion and middle portion are configured to form an enclosure. In an open position at least one side of the middle portion is accessible, and at least one side of either the top or bottom portion is accessible, at least one side of the middle portion comprising structures adapted for holding school supplies, at least one side of the top portion comprising a write-on wipe-off surface. The bottom portion includes a drink restraint for holding a drink item and a snack restraint for holding a snack item. A clip is operatively connected to one side of the top portion for holding paper.

13 Claims, 4 Drawing Sheets

APPARATUS AND METHOD FOR STORING SNACK ITEMS AND SCHOOL SUPPLIES

BACKGROUND OF THE INVENTION

The present invention relates to an apparatus and method for storing snack items and school supplies. More particularly, the present invention relates to an apparatus and method that allows students to use a single container for storing and transporting both school supplies and snack items.

Students are experiencing increasingly long days. Throughout the day it is thought that it is beneficial or desirable for students to eat snacks, preferably snacks that have been selected by a child's primary caregiver for nutritional reasons or personal preferences of a student. Some schools allow students to bring snacks to school every day. Also, students often go to after school care centers and need writing materials and a snack. Students who go straight home after school like to have a snack while they sit down and do homework. There are, of course, other situations where it is desirable for children to have access to snacks. Parents taking children on short or long trips may want to pack activities and a snack for children to use. There is a need for an invention that combines materials for homework with a snack. No longer will homework get wrinkled or snacks get smashed inside a backpack.

A number of carriers or containers that can be used for both food items and school or office supplies are disclosed in the prior art. Cooper, U.S. Pat. No. 3,777,418, discloses a lunch box for transporting food items as well as crayons that are contained within a pouch of the device. The lunch box can also be used as a writing surface. However, Cooper does not disclose a clip for paper, or holders for other school supplies besides crayons.

Shook et al., U.S. Pat. No. 4,106,597, discloses what it calls a food attache case that can be used to carry documents as well as food. It provides specific inserts for carrying different types of food items. However, Shook does not provide holders for school supplies except for paper.

Maydwell et al., U.S. Pat. No. 5,595,302, discloses a lunch box which includes a compartment for storing a cup as well as special attachments for storing an eraser or pens. A juice container can be placed within the lunch box. However, Maydwell et al. does not provide pouches for securing computer disks and scissors. Furthermore, Maydwell et al. does not provide a clip to hold paper.

Licata, U.S. Pat. No. 6,371,288, discloses a student traveling kit. The kit includes a sturdy carrying case with compartments that provide a place for homework, snacks, games, and personal items. However, Licata does not provide pouches for securing crayons, pencils, erasers, computer disks and scissors. Furthermore, there is no clip for paper.

Therefore, despite these and other prior art attempts, problems remain.

SUMMARY OF THE INVENTION

The present invention includes an improved apparatus for storing and transporting both school supplies and snack items. The apparatus of the present invention is configured to conveniently store and transport school supplies such as pencils, paper, erasers, crayons, scissors, a ruler and other school supplies. In addition, the present invention is configured to secure one or more snack items. The apparatus is preferably configured to also provide for securing a drink item. Preferably the apparatus of the present invention is rigid in nature and includes a write-on wipe-off surface. It is also preferred that the apparatus of the present invention include a clip for holding paper in place.

The methodology of the present invention recognizes that specially packaged snack items and drink items can be used with the present invention. These snack items and drink items are preferably packaged in disposable containers with refill snack items and drink items available.

DETAILED DESCRIPTION OF THE PREFERRED EMBODIMENT

The invention is an apparatus for storing student school suppliers and snack items. Specific embodiments of the present invention are described herein, however, the present invention is not to be limited to these specific limitations, but rather only by the claims and equivalents thereto.

Figure 1:
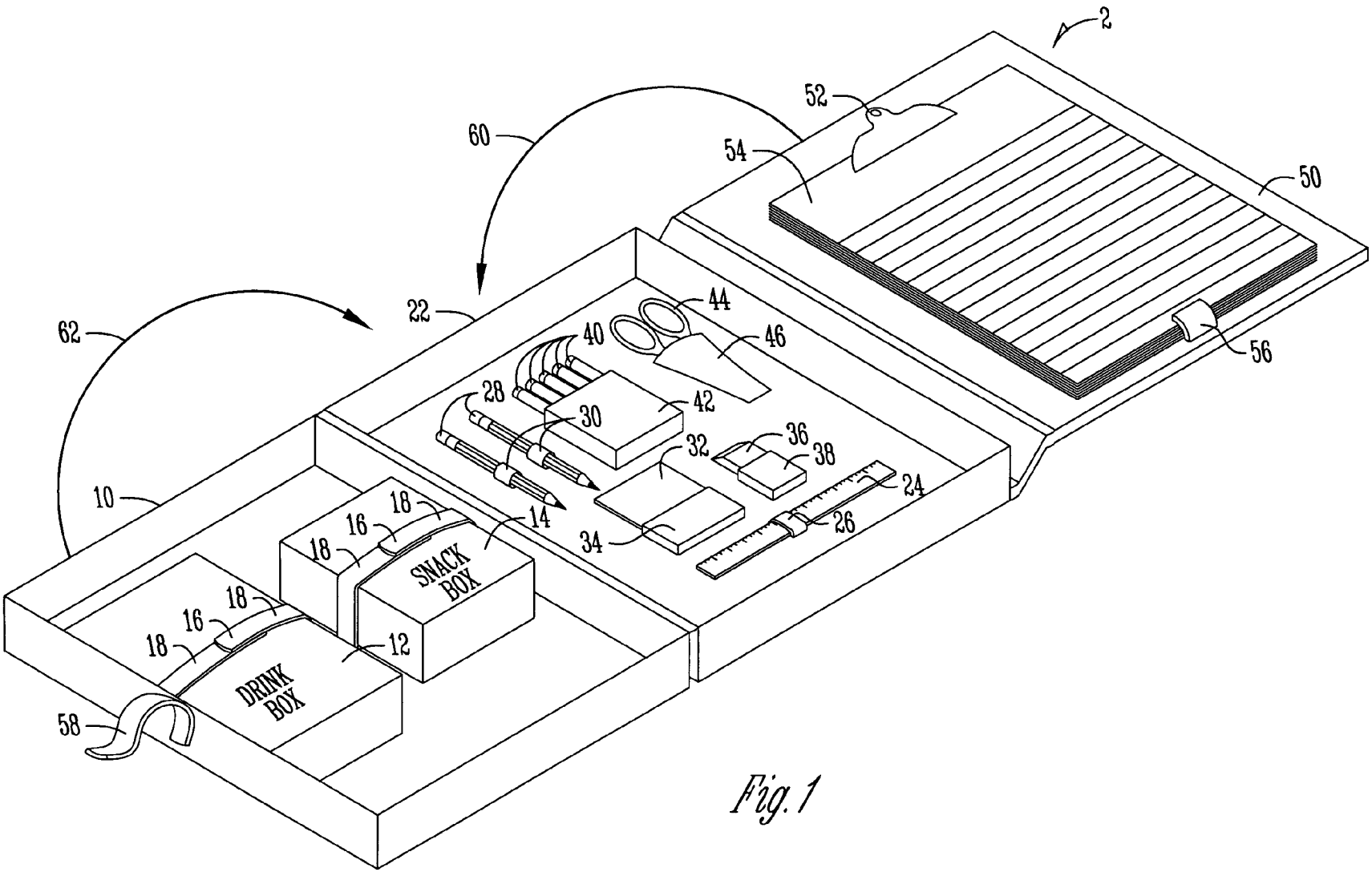
FIG. 1 is a perspective view of one embodiment of the present invention.

FIG. 1 provides a perspective view of one embodiment of the present invention. In FIG. 1, an apparatus 2 shown in an open position. The apparatus 2 is suitable for storing and transporting school supplies and snack items. The apparatus 2 includes a top portion 50, a middle portion 22 and a bottom portion 10 that fold together to form an enclosure for storing and transporting school supplies and snacks. The present invention contemplates many different configurations of the top portion 50, middle portion 22 and bottom portion 10. For example, the top portion 50 can fold along arrow 60 and then the bottom portion 10 can fold towards the middle portion 22 in the direction indicated by arrow 62.

The bottom portion 10 includes restraints 18 with fasteners 16, such as loop and hook or VELCRO® fasteners in order to secure or hold a drink item 12 and a snack item 18. Preferably the drink item 12 and snack item 18 are packaged in disposable containers, but the present invention contemplates variations.

The middle portion 22 is adapted to store various types of school supplies. Although some types of school supplies are specifically described herein, the present invention contemplates those other types of school supplies may also be secured and stored within the enclosure 2. Examples of school supplies that are secured to the middle portion 22 include a ruler 24 which is secured with a ruler strap 26. One or more pencils 28 can be secured to the middle portion 22 through a strap or restraint 30. The present invention contemplates that various types of restraints can be used, including straps, pouches, or other restraints used to hold items such as school supplies. A computer disk 32 is held in place with a computer disk pouch 34. The present invention contemplates the specialized restraints such as straps or pouches can be used for other types of media as well, including CDs. An eraser 36 is held within an eraser restraint 38. Crayons 40 are held in place with a crayon pouch 42. Scissors 44 are held in place with a scissors pouch 46. It is preferred that the restraint for holding scissors be a pouch 46 as shown, or other type of restraint that would protect a student from the blades of the scissors 44.

The top portion 50 is shown with a clip 52. The clip 52 is used for clipping paper within the enclosure 2. When the enclosure 2 is used by students, it is at times particularly desirable to clip notes between parents and teachers to the enclosure 2 using the clip 52. The present invention also contemplates having a retainer 56 opposite the clip 52 to further secure the paper 54 to the enclosure 2.

The present invention contemplates that numerous product configurations can be used to form the enclosure of the present invention. The present invention further contemplates that the enclosure is large enough to also store additional items such as a library book. FIGS. 2–5 illustrate an alternative embodiment of the present invention. In FIGS. 2–5, instead of a folding structure, a top and bottom portion are hinged together with a middle portion such as a flap between the top and bottom portions.

Figure 2:
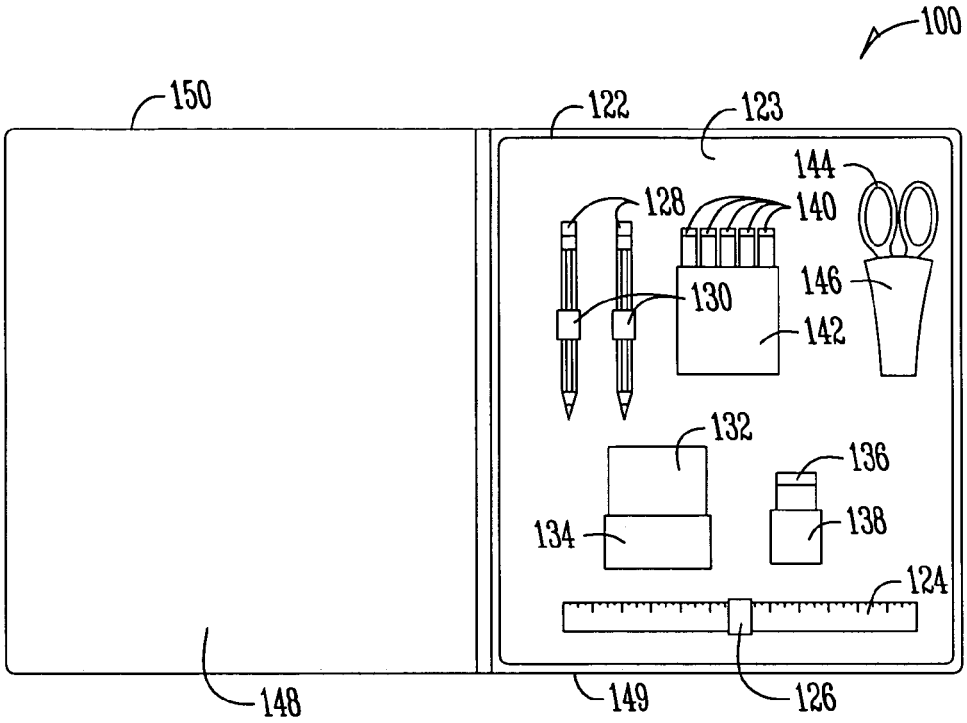
FIG. 2 shows a top view of one embodiment of the interior of the present invention including with an inside flap situated on the right.

In FIG. 2, a top portion 50 includes a write-on wipe-off surface. This write-on surface can be on the inside surface, or the outside surface of the enclosure. The surface allows ink, pencil or crayon to be removed with a towel, solvent, and/or an eraser. The surface can also be a dry erase surface which uses a dry erase marker and eraser. The middle portion 122 is also shown. Attached to the face of the flap 123 shown are a number of restraints such as straps or pouches for holding various types of school supplies. For example, there is a ruler restraint 126 shown for securing a ruler 124 to the flap 122. There are also two pencils 128 that are secured with a pencil restraint 130. There is also a pouch 134 that can be used to hold a floppy disk 132. Similarly, there is a pouch 138 that can be used to hold an eraser 136. A pouch 142 is shown for containing a set of crayons 140. A pouch 146 is shown for retaining a pair of scissors 144. Behind the flap 122 is another portion 149 of the enclosure.

Figure 3:
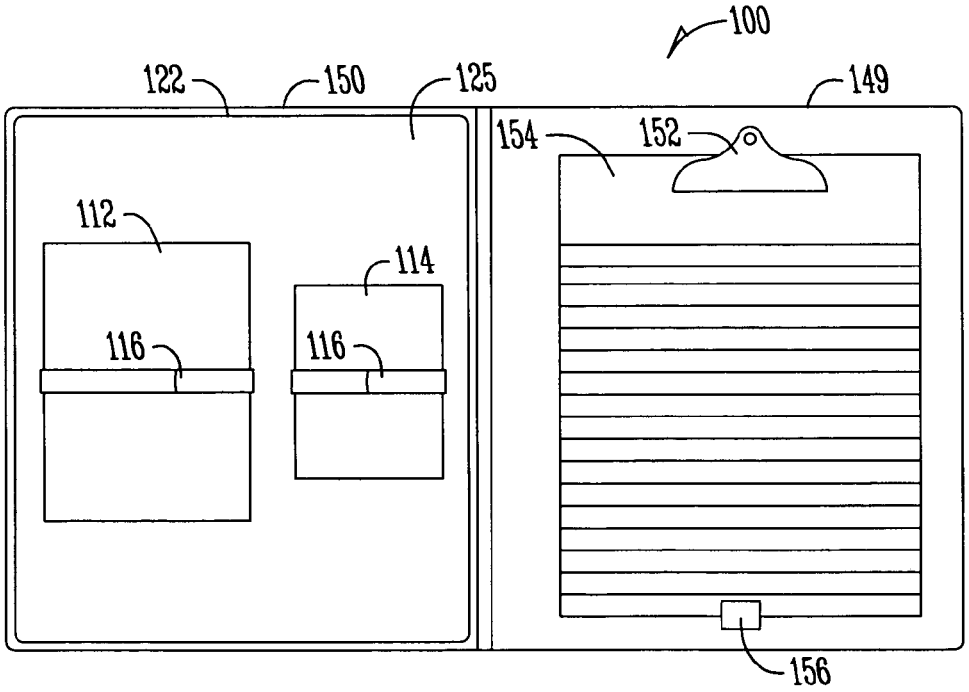
FIG. 3 shows a top view of the embodiment shown in FIG. 2 except the inside flap is situated on the left.

FIG. 3 illustrates an enclosure 100 when the flap is in an alternate position. The opposite side of the flap 122 is shown. A restraint 116 for holding a small book 112 is shown. Similarly, a restraint 116 for holding a CD case 114 is shown. The present invention contemplates that school supplies can be placed on either side of the flap 122. The present invention contemplates variations in the number and type of restraints as well as the side of the flap that the restraints are placed on. Also shown in FIG. 3 is a bottom portion 149 of the enclosure 100. There is a clip 152 operatively connected to the bottom portion 149 for holding such things as paper 154 in the enclosure. There is also an additional restraint 156 for providing easier securement of the paper to the enclosure 100.

Figure 4:
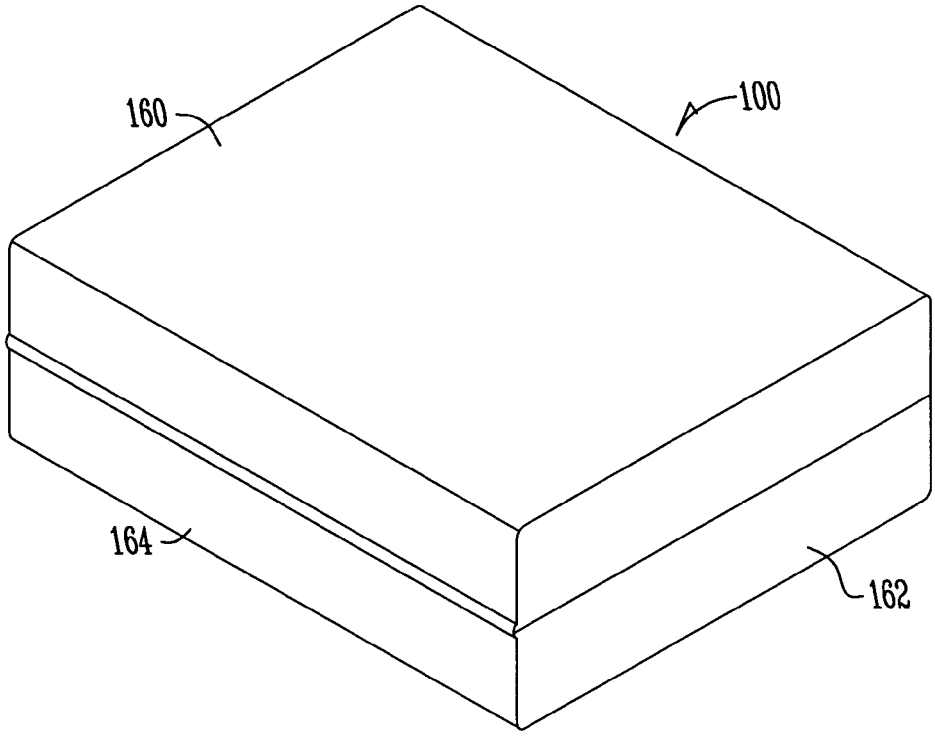
FIG. 4 is a perspective view of the embodiment of FIGS. 2 and 3 in a closed position.

FIG. 4 illustrates a perspective view of the enclosure 100 when the enclosure is in a closed position. A top side 160 is shown that may be a write-on wipe-off or dry erase board so that a student can draw on the surface with pen, marker, or other writing utensils and then clean off the surface. A bottom surface 162 and a side surface 164 are shown.

Figure 5:
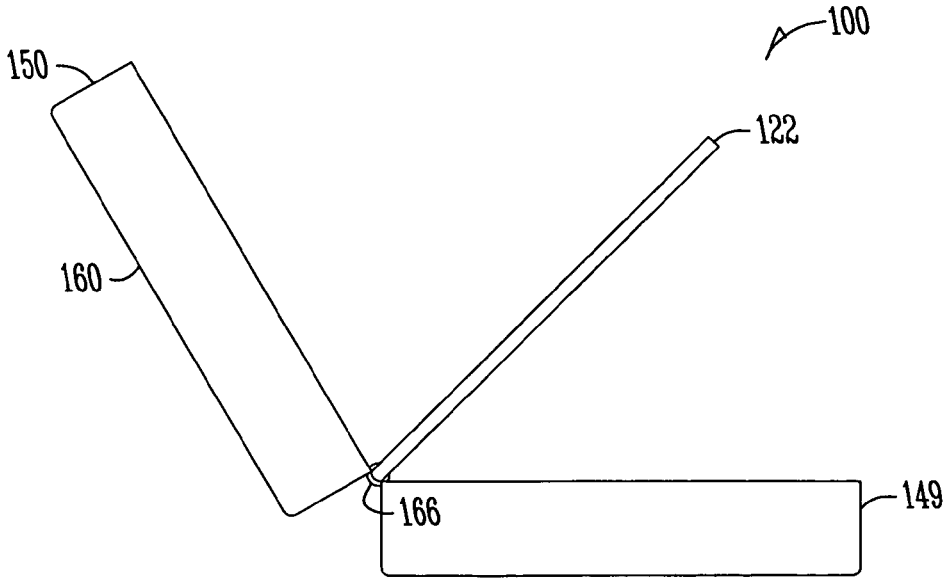
FIG. 5 is a side view of the embodiment of FIGS. 2–4.

FIG. 5 illustrates the side view of the closure 100 in an open position. A bottom portion 149 is shown connected by a hinge 166 to the newer portion or flap 122 and the top portion 150. The hinge 166 is shown that allows the flap 122 to move with respect to the bottom portion 149 and the top portion 150. The present invention contemplates that various structures can be used instead of the hinge 166 shown.

Figure 6:
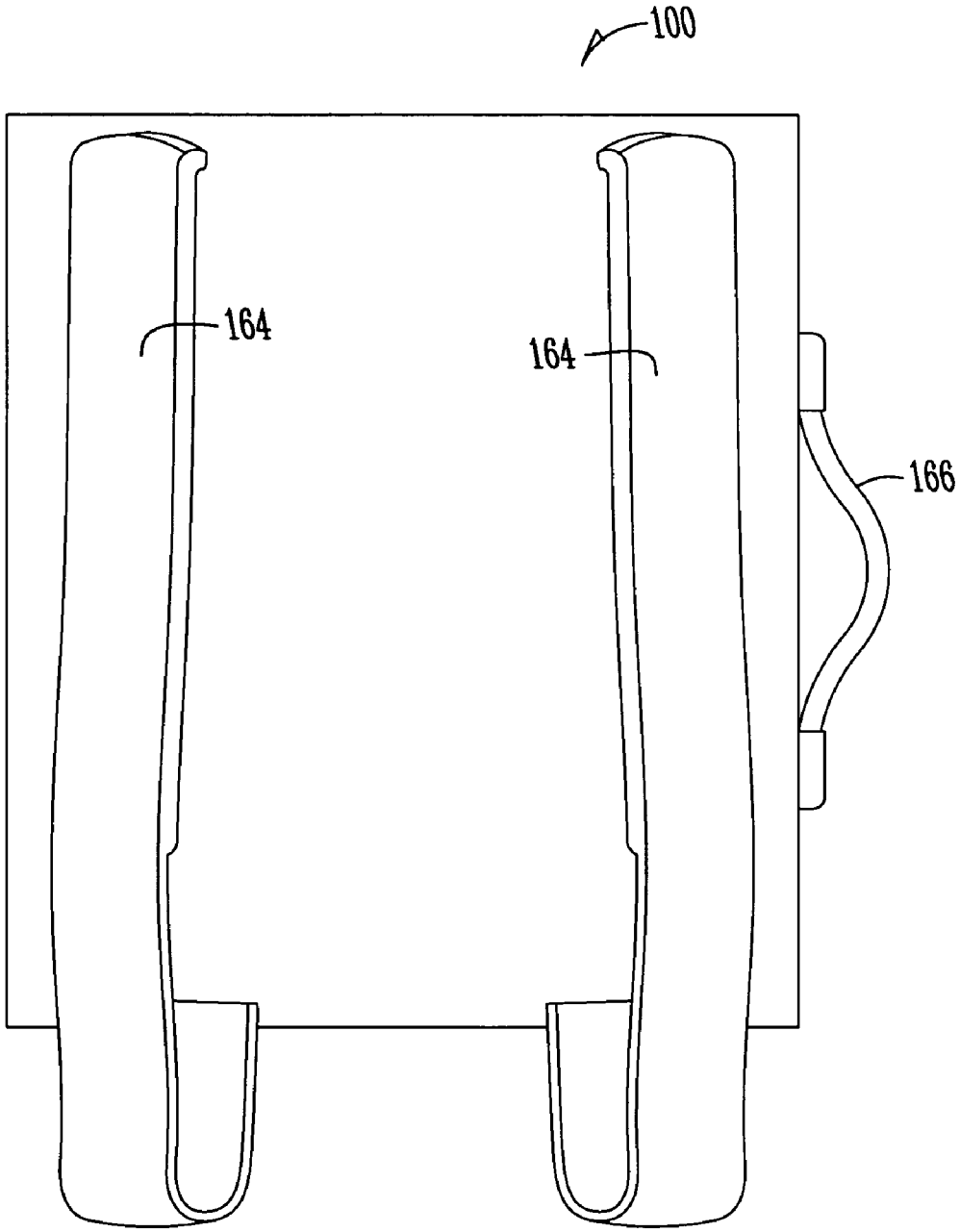
FIG. 6 is a perspective view of the embodiment of the present invention shown with straps attached thereto to be worn as a backpack.

FIG. 6 illustrates an optional embodiment of the present invention. Backpack straps 164 are attached to the enclosure 100 so that a student can simply wear the enclosure 100. Alternatively, a handle 166 can be used in place of the backpack straps, or both options can be available at the same time. These and other variations are contemplated by the present invention.

The methodology of the present invention relates to providing the apparatus and its various embodiments previously described. The method further relates to providing snack items and drink items in disposable containers for use in the apparatus. The product configuration of the snack items and drink items is preferable such that these items can be easily and safely secured. Preferably, the snack items and drink items are sold as refills.

The present invention contemplates numerous variations in materials used, configurations, shapes, sizes, and other variations within the scope of the invention now claimed.

What is claimed is:

1. An apparatus for storing and transporting supplies and snacks, comprising:

a snack item;

a drink item;

a top portion having first and second opposite sides;

a bottom portion having first and second opposite sides;

a middle portion having first and second opposite sides, the middle portion operatively connected to the top portion and the bottom portion;

wherein in a closed position the top portion, bottom portion and middle portion are configured to form an enclosure;

wherein in an open position at least one side of the middle portion is accessible, and at least one side of either the top or bottom portion is accessible;

at least one side of the middle portion comprising structures adapted for holding school supplies;

at least one side of the top portion comprising a write-on wipe-off surface;

wherein one side of the bottom portion includes at least one drink restraint adapted for holding the drink item and at least one snack restraint adapted for holding the snack item; and a clip operatively connected to one side of the top portion for holding paper.

2. The apparatus of claim 1 wherein the middle portion is a flap and the top portion is a lid, in a closed position.

3. The apparatus of claim 1 wherein the drink item is a drink box and the drink restraint is adapted for holding the drink box.

4. The apparatus of claim 1 further comprising first and second back pack straps operatively connected to the bottom portion.

5. The apparatus of claim 1 wherein the structures adapted for holding school supplies include at least one pencil holder.

6. The apparatus of claim 5 wherein the structures adapted for holding school supplies further include a scissor holder.

7. The apparatus of claim 6 wherein the structures adapted for holding school supplies further include a computer disk holder.

8. The apparatus of claim 7 wherein the structures adapted for holding school supplies further include a crayon pouch.

9. A method comprising:

providing an apparatus for storing and transporting supplies and snacks, comprising:

(a) a top portion having first and second opposite sides;

(b) a bottom portion having first and second opposite sides;

(c) a middle portion having first and second opposite sides, the middle portion operatively connected to the top portion and the bottom portion;

(d) wherein in a closed position the top portion, bottom portion and middle portion are configured to form an enclosure;

(e) wherein in an open position at least one side of the middle portion is accessible and at least one side of either the top or bottom portion is accessible;

(f) at least one side of the middle portion comprising structures adapted for holding school supplies;

(g) at least one side of the top portion comprising a write-on wipe-off surface;

(h) wherein one side of the bottom portion includes at least one drink restraint for holding a drink item and at least one snack restraint for holding a snack item; and (i) a clip operatively connected to one side of the top portion for holding paper; providing a snack item having a product configuration adapted for placement in the apparatus, and for securement by the at least one snack restraint, said snack item packaged in a disposable package;

placing the drink item in the apparatus and securing the drink item with the at least one drink restraint; and placing the snack item in the apparatus and securing the snack item with the at least one snack restraint.

10. The method of claim 9 wherein said drink item is packaged in a disposable package.

11. A system for use by a student to store and transport school supplies and snacks, the system comprising:

a snack item;

a drink item;

a school supply item;

a store and transport apparatus comprising:

(a) a top portion having first and second opposite sides;

(b) a bottom portion having first and second opposite sides;

(c) a middle portion having first and second opposite sides, the middle portion operatively connected to the top portion and the bottom portion;

(d) wherein in a closed position the top portion, bottom portion and middle portion are configured to form an enclosure;

(e) wherein in an open position at least one side of the middle portion is accessible, and at least one side of either the top or bottom portion is accessible;

(f) at least one side of the middle portion comprising a restraint for holding the school supply item;

(g) wherein one side of the bottom portion includes at least one drink restraint adapted for holding the drink item and at least one snack restraint adapted for holding the snack item;

(h) first and second back pack straps operatively connected to the bottom portion.

12. The system of claim 11 wherein at least one side of the top portion comprises a write-in wipe-off surface.

13. The system of claim 12 wherein the store and transport apparatus further comprises a clip operatively connected to one side of the top portion for holding paper.

* * * * *